US007661918B2

(12) United States Patent
Knight

(10) Patent No.: US 7,661,918 B2
(45) Date of Patent: Feb. 16, 2010

(54) BINDING MACHINE AND METHOD

(75) Inventor: Colin Knight, Skokie, IL (US)

(73) Assignee: General Binding Corporation, Lincolnshire, IL (US)

( * ) Notice: Subject to any disclaimer, the term of this patent is extended or adjusted under 35 U.S.C. 154(b) by 574 days.

(21) Appl. No.: 10/853,065

(22) Filed: May 24, 2004

(65) Prior Publication Data

US 2004/0240968 A1 Dec. 2, 2004

Related U.S. Application Data

(60) Provisional application No. 60/474,705, filed on May 30, 2003.

(51) Int. Cl.
*B42B 5/08* (2006.01)

(52) U.S. Cl. ..... 412/38; 412/7; 412/42

(58) Field of Classification Search ..... 281/21.1; 412/1, 6, 7, 9, 33, 39, 40, 42, 43, 38; 29/410, 29/430, 469; 227/152, 154, 155
See application file for complete search history.

(56) References Cited

U.S. PATENT DOCUMENTS

| | | | | | |
|---|---|---|---|---|---|
| 1,996,463 | A | * | 4/1935 | Dawson et al. | 402/38 |
| 2,789,561 | A | * | 4/1957 | Johann et al. | 402/35 |
| 3,060,780 | A | * | 10/1962 | Stuckens | 83/590 |
| 3,334,918 | A | | 8/1967 | Pigna et al. | |
| 3,555,587 | A | | 1/1971 | Seaborn | |
| 3,667,076 | A | | 6/1972 | Aglaghanian et al. | |
| 3,839,759 | A | * | 10/1974 | Staats et al. | 412/7 |
| 3,867,968 | A | * | 2/1975 | Ritter et al. | 140/93 D |
| 4,031,585 | A | | 6/1977 | Adams | |
| 4,157,821 | A | * | 6/1979 | Fabrig | 270/58.07 |
| 4,902,183 | A | * | 2/1990 | Vercillo et al. | 412/7 |
| 4,906,157 | A | * | 3/1990 | Todaro et al. | 412/43 |
| 5,090,859 | A | * | 2/1992 | Nanos et al. | 412/11 |
| 5,549,433 | A | * | 8/1996 | Byrne | 412/39 |
| 5,584,632 | A | | 12/1996 | Stiles et al. | |
| 5,683,218 | A | * | 11/1997 | Mori | 412/40 |
| 5,806,750 | A | * | 9/1998 | Yamanushi et al. | 227/155 |
| 6,210,092 | B1 | * | 4/2001 | von Rohrscheidt | 412/40 |
| 6,270,280 | B1 | | 8/2001 | Baumann | |
| 6,374,061 | B1 | * | 4/2002 | Williams | 399/1 |
| 6,554,267 | B2 | * | 4/2003 | Trovinger | 270/52.18 |
| 6,663,331 | B1 | * | 12/2003 | Mori et al. | 412/39 |
| 6,773,216 | B2 | * | 8/2004 | Crudo et al. | 412/39 |
| 2003/0198536 | A1 | * | 10/2003 | Buhler et al. | 412/39 |
| 2004/0052615 | A1 | * | 3/2004 | Fuchs et al. | 412/39 |
| 2004/0115031 | A1 | * | 6/2004 | Horst | 412/38 |
| 2005/0175434 | A1 | * | 8/2005 | Sakata et al. | 412/38 |

OTHER PUBLICATIONS

Admitted prior art, GBC ProClick Spine Binding Tool, 2 pages.

International Search Report and Written Opinion mailed Nov. 1, 2004 for PCT/US04/16687.

Supplementary European Search Report dated Oct. 2, 2008 for EP 04753505, 3 pages.

* cited by examiner

*Primary Examiner*—Dana Ross
*Assistant Examiner*—Jamila Williams
(74) *Attorney, Agent, or Firm*—Michael Best & Friedrich LLP

(57) ABSTRACT

A machine for binding a sheath of punched sheets together by means of a spine binder includes a closing assembly for closing the spine binder over the sheath of punched sheets. The closing assembly includes a rail and a closing tool carried by and movable along the rail, and adapted to engage the spine binder for closing the spine binder over the sheath as the closing tool is moved along the rail.

25 Claims, 4 Drawing Sheets

BINDING MACHINE AND METHOD

PRIORITY INFORMATION

This application claims benefit of priority from U.S. Provisional Patent Application 60/474,705. filed May 30, 2003.

BINDING MACHINE AND METHOD

This invention relates to mechanism and a method for binding a sheath of papers or the like and is particularly directed to such devices of the kind which may be used for short runs to punch, collate and bind and rebind a sheath into a booklet using of a spine-like binding. The invention provides a novel tool for closing the spine thus binding such a booklet and, additionally, teaches the binding process using this tool to bind, open and rebind such a booklet.

BACKGROUND OF THE INVENTION

Devices useful for assembling and binding short run booklets have included staples and stitching, ring binders, prong and post binders, compression clips, heat seal and glue binders, comb and spiral binders (both metal and plastic) and like fasteners, but all of such devices have had problems with their binding process and materials, particularly strength or versatility of the binding devices and materials, permanency of the binding, correctability of the bound work once binding was completed, cost of the equipment and materials, re-usability of the bound work, ease of use and opening and closing and re-opening of the bound work, and other problems.

One new and effective binder is the Spine Binder disclosed in Baumann U.S. Pat. No. 6,270,280, granted Aug. 7, 2001. This spine binder, molded from plastic material, has substantial strength, provides permanent binding, and the spine is also openable if corrections or editing of the bound work is required. The spine binder is characterized by sets of opposed individual ribs or fingers, extending from a dorsal spine hinge, the ribs being cooperatively arranged to mate and snap together when the hinge is manipulated to move the opposed extended fingers together. However, this spine binder does not provide a fast and efficient means for loading the papers to be bound, for preparing the spine binder for use, and for opening and closing the spine binder in a simple and expedient manner because the opposed finger must be disposed properly to meet and separate every time when opening or closing the spine binder. The present invention deals with the binding and opening and rebinding of such a spine binding device and a method for accomplishing the same.

SUMMARY OF THE PRESENT INVENTION

In the present invention, a binding machine is provided which has structure for receiving papers, including covers, or other materials to be bound and for efficiently punching binding holes in an edge of the aligned papers and covers to receive a spine binder of the character described above. This binding machine has means which arranges and positions an open binding spine of the kind referred to in Baumann U.S. Pat. No. 6,270,280, prepares its hinge in condition for closing, and compresses the spine binder and then in a zipper-like fashion the extended ribs or fingers of the spine binder are accurately closed and snap engage into one another, thus binding the booklet. This same binding device may also have an opening tool which is used to open the engaged closed spine ribs or fingers, spreading them apart, and thus re-opening the bound booklet for editing and rebinding.

The opening and closing may be accomplished time and again with the same spine and booklet, thus permitting easy updating and editing, using some of the same pages and covers as desired and the same spine binder, and adding pages to or deleting them from the work. If more or fewer pages are to be in the booklet during subsequent re-bindings, a larger or smaller spine binder may be utilized, as appropriate. The binding device also includes novel holding hooks which properly align the open spine binder for accurately receiving it arranged to accommodate the punched papers and for closing.

OBJECTS AND ADVANTAGES OF THE INVENTION

It is the object of the present invention to provide a novel spine binder device of the character referred to.

Another object is to provide a novel spine binder device for preparing a sheath of sheets to be bound or unbound and for preparing a spine binder for binding such a sheath.

Another object is to provide novel holding hooks for a binding machine which receive an open spine binder positioned to receive aligned punched sheets and the open spine binder arranged for closing of the spine binder to bind the sheets into a booklet.

Another object is to provide a novel closing tool arranged on a binding machine adapted to prepare and close an open spine binder and bind papers into a booklet.

Another object is to provide a novel opening tool on a binding machine adapted to open a closed spine binder binding a sheave of papers without damaging the spine binder or papers, so that the spine may be reused and the papers may be edited and rebound.

Another object is to provide a novel zipper-like closing tool for a spine binder which is adapted to travel a predetermined course over a closing arm to close the spine binder over a sheaf of punched papers.

Another object is to provide a novel closing tool which has squeezable wings adapted to selectively close a spine binder over a sheaf of papers.

Another object is to provide a binding machines and closing and opening tools for opening and closing a spine binder over a sheaf of papers, such a machine and tools being economical and efficient to manufacture and simple and expedient in operation and use.

Another object is to provide a method for preparing, holding, closing, reopening and reclosing a spine binder over a sheath of papers or the like.

These and other objects and advantages of the invention will become more apparent as this description proceeds, taken in conjunction with the accompanying drawings.

BRIEF DESCRIPTION OF THE DRAWINGS

In the drawings:

FIG. 5 shows the step of determining the spine size.

FIG. 6 shows the first step of binding the sheath, namely positioning the open spine binder underneath the holding hooks of the closing tool.

FIG. 7 shows the step of preparing the spine binder for binding and collating and threading the sheath of papers on to the open spine binder, by depressing the distal longitudinal center of the spine binder in preparation for closing.

FIG. 8 shows the step of closing the open spine binder around the sheath of papers using the closing tool.

FIG. 9 shows the shows the step of zippering the spine binder closed over the entire length of the spine and releasing the sheath of sheets from the holding hooks of the closing tool.

FIG. 10 shows the additional step of opening the closed spine binder by using the opening tool for editing the sheath of sheets, if desired.

FIGS. 5-10 each include arrows which depict the direction of action in performing the steps described.

DESCRIPTION OF PREFERRED EMBODIMENTS

Figure 1:
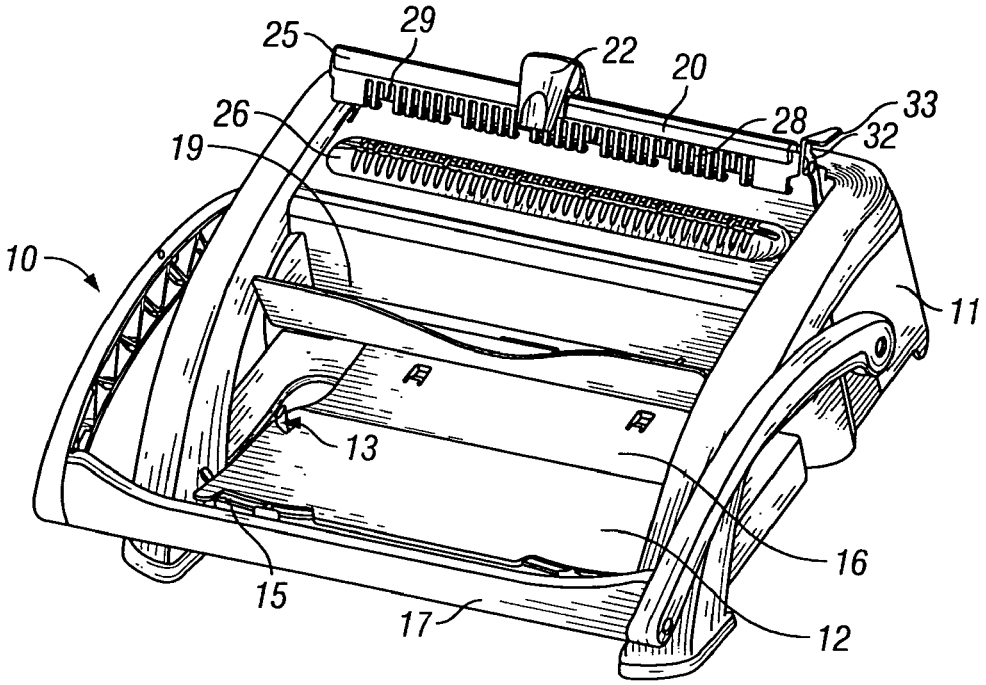
FIG. 1 is a perspective view of the binding machine embodying the present invention.
Figure 2:
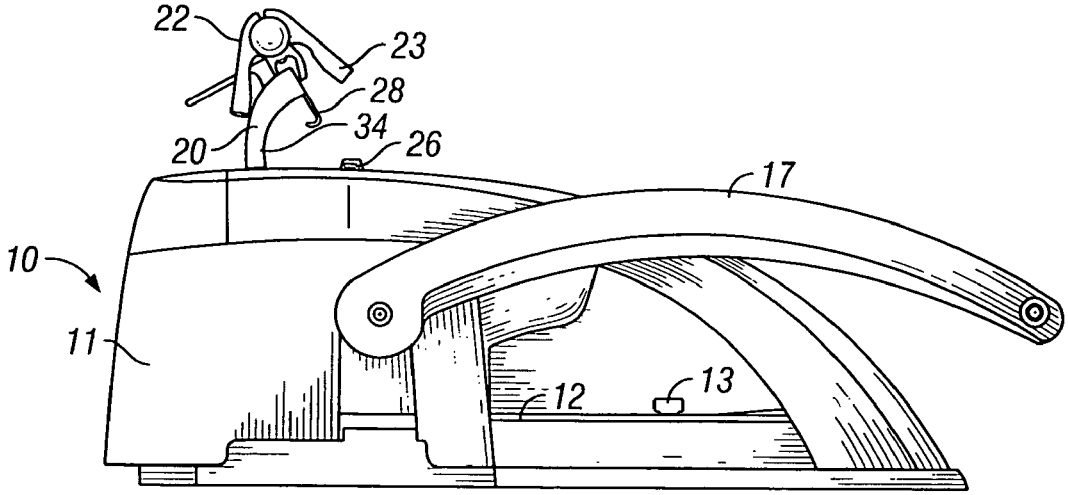
FIG. 2 is a side view of the device shown in FIG. 1.

With reference to FIGS. 1 and 2, a binding machine 10 of the character described may comprise a body 11 having a bed 12 for receiving a sheath of papers P (shown in FIG. 7) to be bound, and the body may include an edge guide 13 for entering the size of the papers to be bound and a spine guide 15 for entering the size of the spine binder S (shown in FIGS. 3 and 5-10) to be used in binding the sheath. The papers P to be bound are inserted into a punch throat 16, where appropriate punches are made on the edge of the aligned papers of the sheath when the punch handle 17 is manipulated. The body may also include a storage compartment for containing report covers, and another storage compartment 19 for containing open spines.

Along the top of the body 11 is a novel closing arm 20, for receiving and closing an open spine S of a binding device, e.g. the kind disclosed in Baumann U.S. Pat. No. 6,270,280. A novel closing tool 22, slideably carried by the closing arm 20, has a pair of opposed normally open spring mounted wings 23, each of which has bearing members 24 adapted to close an open spine binder S. This closing tool 22 is slideably disposed on a rail 25 forming a part of the closing arm 20, and may be manually slidably manipulated zipper-like from side to side on the closing arm of the binding machine 10.

Preferably, the closing arm 20 is pivotally connected to the body 11 by brackets 34 so that the arm may be raised and lowered against a platen 26 extending along the body 11 of the binding machine in a position aligned with fingers 28 on the closing arm 20.

Spaced along the platen 26 are a series of spaced apart hooks 21, and the short fingers 29 on the closing arm 20 aligned with these hooks are shortened to accommodate them. Preferably, the platen 26 has a longitudinally extending central channel 30; and a series of spaced apart slots 31 corresponding to and is adapted to receive the fingers 28 on the closing arm 20 when the closing arm is lowered against the platen.

The binding machine 10 at one end of the body 11 arranged next to the end of the closing arm 20 may carry an upstanding opening tool 32; and this tool has a tapered arm 33 for spreading the ribs or fingers F of a spine binder S apart to open the closed spine binder when editing a sheath of papers.

The closing tool 22 and its associated zippering and closing structure may be independent of the binding machine 10 and comprise a separate mechanism usable in opening and closing the spine and its ribs or fingers F independently of the punching and storage mechanism, and with or without the closing tool, which may be separate from the closing arm 20 and associated zippering and closing structure.

Figure 3:
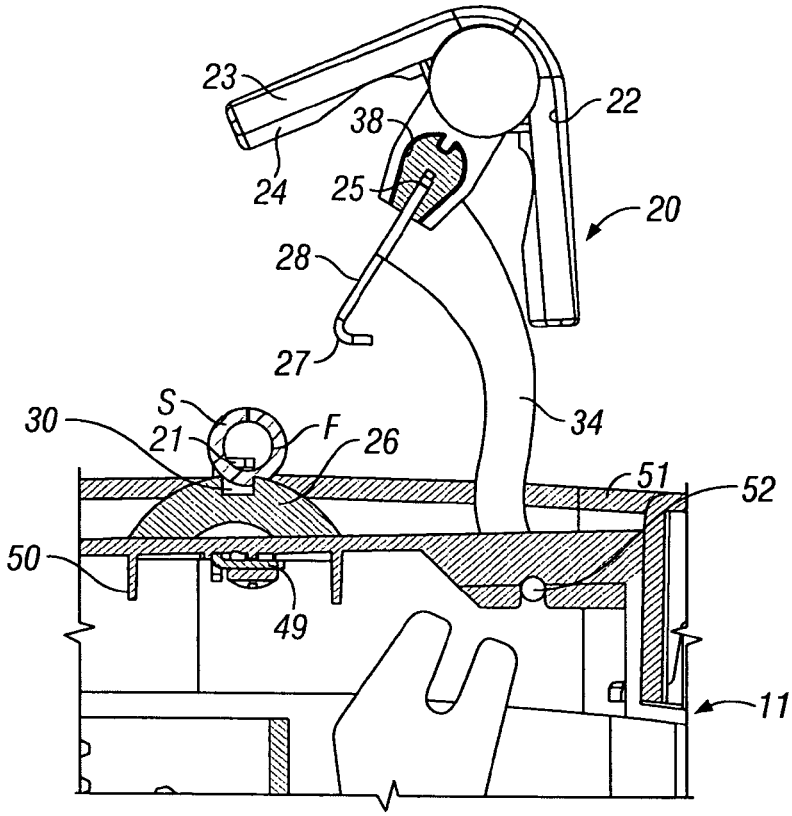
FIG. 3 is a section view of part of the binding machine showing the closing tool and part of the binding device, with a spine binder in position shown closed.
Figure 4:
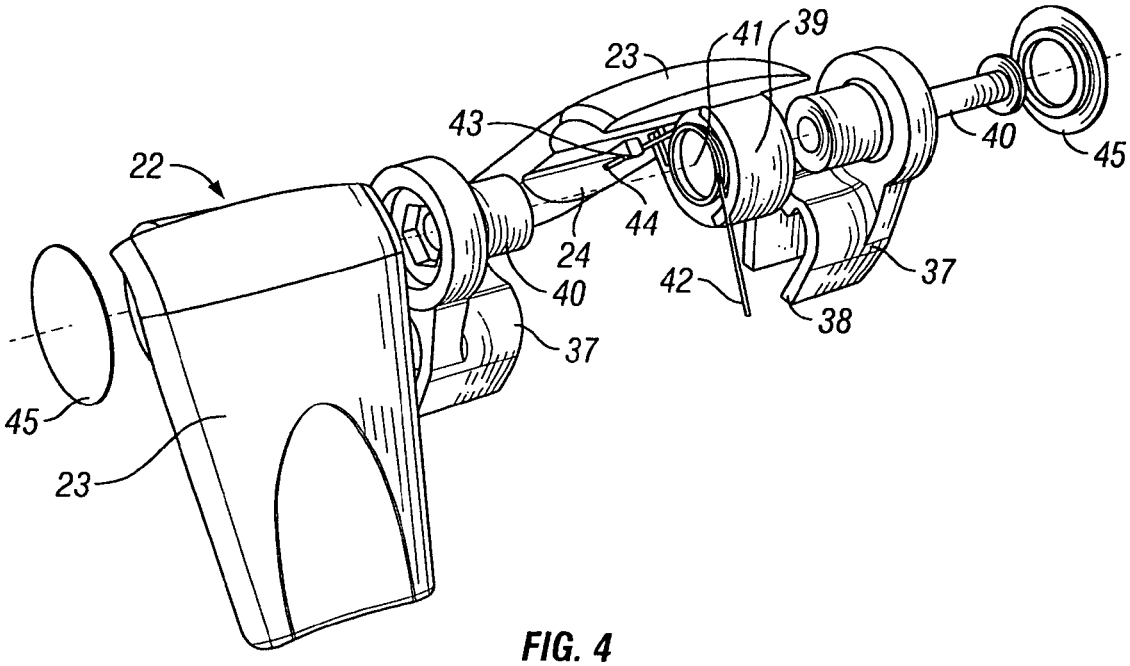
FIG. 4 is an isometric or exploded view of the winged zipper-like closing tool embodying the invention.

A preferred exemplary closing tool 22 and associated structure is shown in FIGS. 3 and 4, wherein two like wings 23 slidably arranged opposed to one another on the closing tool rail 25 by means of like wing mounting brackets 37, one for each wing, each of which has a like inverted u-shaped channel 38 adapted to slidably engage over the rail. These wings 23 each have an extension 39 which has an aperture 41 engaged over an axle 40 in each of the associated brackets 37. A spring 42 is threaded over the axle 40 between the wings 23 to bias the wings away from the rail 25 unless the wings are pressed toward one another in a position to close the spine binder. A stop 43 on each of the wings 23 engages an end 44 of the spring 42 to hold the wings 23 normally in an open position away from the closing tool rail 25 and to permit the wings to move toward the rail under finger pressure during closing, as hereafter described. Axle caps 45 may be provided to close over each of the opposed ends of the axle 40, securing the wings 23 on the rail 25 as described.

Figure 5:
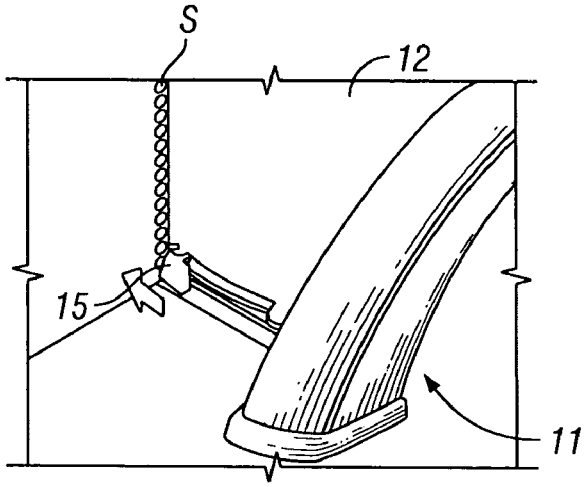
FIGS. 5-10 show the steps in binding a sheath of papers according to the present invention, as follows.
Figure 6:
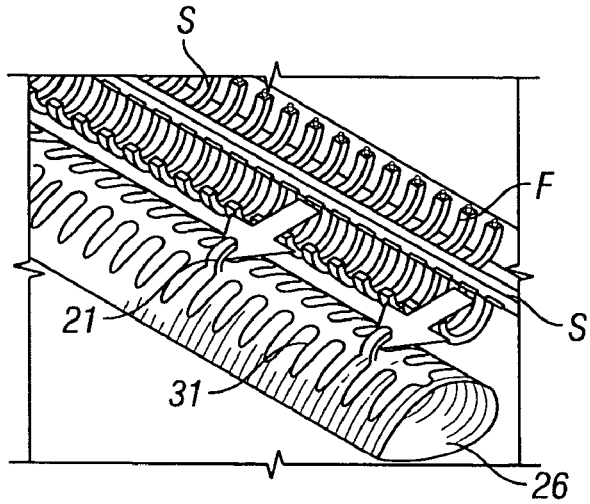

With reference to FIGS. 5-10, the binding method is shown in those respective figures in sequence. In FIG. 5, the spine binder size is ascertained by moving the spine size guide 15 on the bed 12 in the direction of the arrow Then, as shown in FIG. 6, the open spine binder S is hooked onto the hooks 21 of the platen 26, whereupon, the open ribs or fingers F of the spine binder S are threaded into the holes formed in the sheath of sheets P in the direction of the arrow A (shown in FIG. 7).

Figure 7:
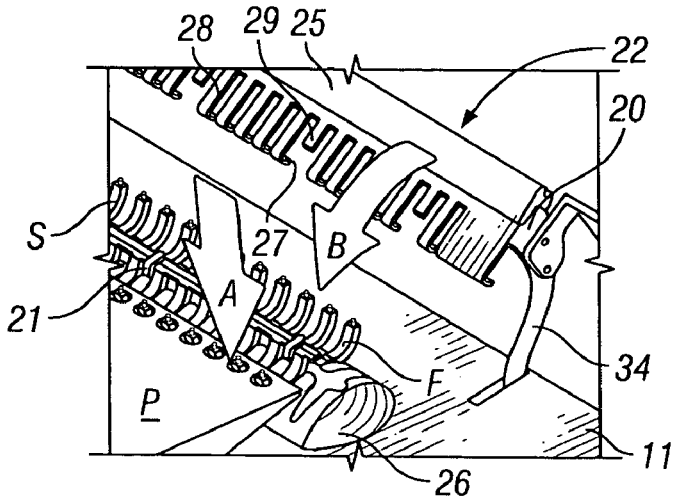
Figure 8:
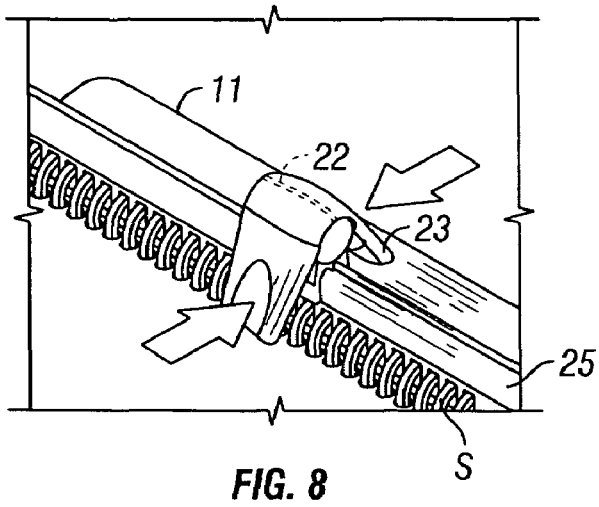

The hooks 21 extend upwardly from the platen 26 as shown in FIG. 7. The closing tool 22 is swung in the direction of the arrow B against the open spine S. The longitudinally extending channel 30 in the center of the platen 26 is adapted to receive the distal central area between the ribs or fingers F of the spine binder S arranged in alignment with the closing fingers 28 on the closing arm 20. The ends of the closing fingers 28 are bent rearwardly to form hammers 27 arranged to press downwardly on the longitudinal distal center of the spine binder S to partially close it. Preferably, the hooks 21 are carried by a bar 49 securely positioned beneath the platen 26, and are also reinforced by platen reinforcing ribs 50.

The closing arm 20 has on each end a closing arm bracket 34, and this bracket 34 is pivotally captured within the body 11 of the binding machine frame 51 and pivotable on closing arm pins 52.

Preferably, the interior surface of each of the wings 23 has a tapered bearing face 24 which bears against the spine binder S during the zipper-like closing operation, hereafter described.

In use, with the exemplary binding machine 10 shown, the edge guide 13 is set to the size of the paper P comprising the sheath to be bound, and the aligned sheets and a cover may be thrust into the punch throat 16, whereupon the punch handle 17 may be pulled towards the paper bed 12 and down, to make the punch (conventional internal punches not shown). The punched sheath of papers and cover may then be placed into the spine size guide 15, so that an appropriately sized spine binder may be selected to bind the document.

The closing arm 20 is raised and the open spine binder S is secured to the hooks 21 and positioned on the platen 21. The document to be bound is then collated and threaded onto the open spine binder S, as shown in FIG. 7, in the direction of arrow A. The closing arm 20 is then lowered and pushed downwardly in the direction of arrow B in FIG. 7 to depress the longitudinal distal central area of spine binder S so that the distal area is essentially partially broken and made hinge-like and flexible by the finger hammers 27 for its future closing operation.

Figure 9:
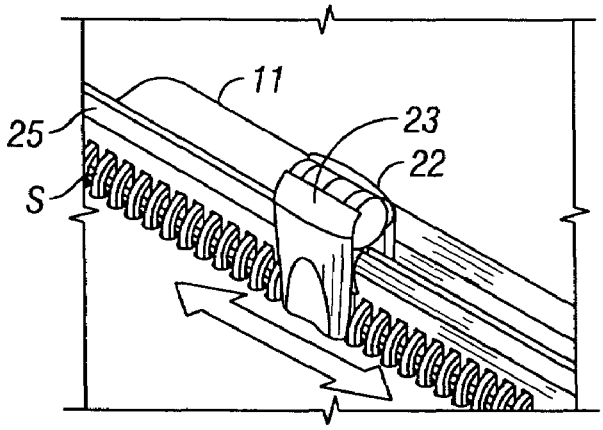

The sheath of sheets F is arranged on the spine binder ribs or fingers F, whereupon the spring mounted wings 23 of the closing tool 22 are pressed together (as shown by arrows in FIG. 8), so that the wings cam bearing members 24 aligned with and corresponding to closing portions of the ribs or fingers F of the spine binder S and the closing tool 22 is manipulated zipper-like on the closing tool rail 25, from side to side to complete the book binding operation, as shown in FIG. 9.

Figure 10:
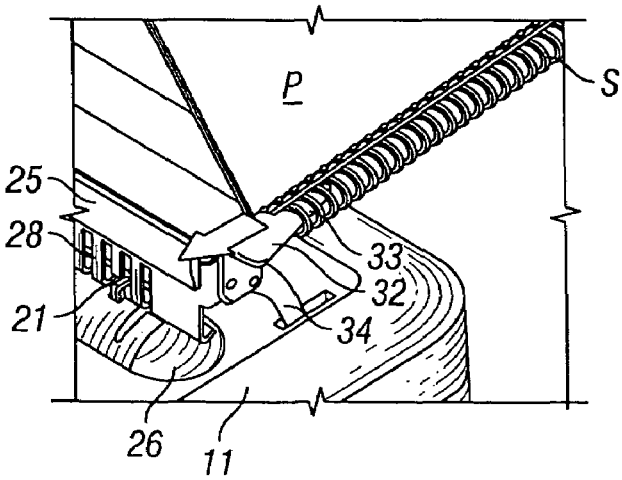

If one desires to open the bound book, the closed spine binder S is threaded over the tapered arm 33 of the opening tool 32 and moved in a direction of the arrow in FIG. 10, spreading the ribs or fingers F apart, thus opening the bound sheath of sheets P, in order to add, replace or remove a page of the bound book. The bound book may be closed again by moving the closing tool 22 over the open loaded sheath in the manner previously described.

While a preferred embodiment of the invention has been shown and described in considerable detail, it should be understood that modifications and changes in the structure and use of part or all of the assembly may be used within the spirit and scope of the invention, and it is not desired that the invention should be limited to the exact construction and method shown, except as limited by the claims of a this utility patent application.

What is claimed is:

1. A machine for binding a sheath of punched sheets together by means of a spine binder, said binding machine having a closing assembly for closing said spine binder over said sheath of punched sheets, said closing assembly comprising;

(a) a rail, and (b) a closing tool carried by and movable along said rail, and adapted to engage said spine binder for closing said spine binder over said sheath as said closing tool is moved along said rail, wherein said spine binder has a plurality of sets of opposed ribs spaced apart from each other and connected by a distal central area, and said closing tool has a bearing member carried by and movable along said rail, and operable to engage said spine binder for moving opposed ribs of each set of opposed ribs against one another over said sheath as said bearing member is moved along said spine binder.

2. In the binding machine recited in claim 1, wherein said machine has a body for receiving said sheath of sheets aligned for punching, and said closing assembly is mounted on said body.

3. In the binding machine recited in claim 2, wherein said binding machine has an opening tool mounted on said body.

4. In the binding machine recited in claim 3, wherein said opening tool comprises a tapered finger adapted to engage a closed spine and spread it open.

5. In the binding machine recited in claim 1, wherein said closing tool is biased away from said rail and adaptable to close said spine binder when said closing tool is moved against said spine binder.

6. In the binding machine recited in claim 2, wherein said closing assembly is pivotally secured on said body.

7. In the binding machine recited in claim 2, wherein a platen is arranged on said body in alignment with said closing assembly.

8. In the binding machine recited in claim 1, wherein said closing assembly has a series of spaced apart fingers arranged in a pattern corresponding to the plurality of sets of opposed ribs of said spine binder.

9. In the binding machine recited in claim 8, wherein said fingers are arranged to bear against said spine binder distal central area when said closing tool is moved along said rail.

10. In the binding machine recited in claim 9, wherein a hammer is formed on the free end of some of said fingers corresponding to said spine binder distal central area.

11. In the binding machine recited in claim 7, wherein said platen is adapted to receive said spine binder distal central area during closing and has a channel formed in said platen in alignment with said closing assembly.

12. In the binding machine recited in claim 11, wherein said body is structurally reinforced beneath said platen.

13. In the binding machine recited in claim 11, wherein said platen has hooks for receiving said spine binder during closing.

14. In the binding machine recited in claim 1, wherein said closing tool comprises a pair of wings coupled to said rail, said wings being normally spread apart.

15. In the binding machine recited in claim 14, wherein said wings are spring mounted on an axle and movable when said wings are pinched together to close said spine binder.

16. In the binding machine recited in claim 1, wherein said machine has (a) a body for receiving a stack of sheets to be bound, and (b) a punch for forming holes in said sheets.

17. In a method for binding a sheath of sheets together using a spine binder having a plurality of sets of opposed ribs spaced apart from each other and extending from a central distal area, said method comprising the steps of:

(a) engaging an open spine binder with said sheath of sheets, and (b) pressing on said central distal area of said spine binder between two adjacent sets of ribs with fingers of a closing assembly so that opposed ribs of each set of opposed ribs are moved exclusively toward one another;

wherein said closing assembly includes a closing tool, and wherein the method further comprises closing said opposed ribs by moving said closing tool along said plurality of sets of opposed ribs in a zipper-like manner.

18. In the method recited in claim 17, with the additional step of punching apertures corresponding to said ribs in said sheets prior to engaging said open spine binder with said sheath.

19. In the method recited in claim 17, further comprising pivoting said closing assembly into engagement with said spine binder.

20. In the method recited in claim 17, wherein said closing tool includes wings that are normally spread apart, and wherein closing said opposed ribs by moving said closing tool along said opposed ribs in a zipper-like manner includes pressing together said wings to contact said plurality of sets of opposed ribs.

21. In a method for binding a sheath of sheets together using a spine binder having a plurality of sets of opposed ribs spaced apart from each other and extending from a central distal area, said method comprising the steps of:

(a) engaging an open spine binder with said sheath of sheets, and (b) closing each of said sets of opposed ribs by moving a closing tool along a rail of a closing assembly and, thereby, along said plurality of sets of opposed ribs in a zipper-like manner.

22. In the method recited in claim 21, with the additional step of punching apertures corresponding to said ribs in said sheets prior to engaging said open spine binder with said sheath.

23. In the method recited in claim 21, further comprising pressing on said central distal area of said spine binder with said closing assembly so that said plurality of sets of opposed ribs are moved toward one another.

24. In the method recited in claim 21, further comprising pivoting said closing assembly into engagement with said spine binder.

25. In the method recited in claim 21, wherein said closing tool includes wings that are normally spread apart, and wherein closing said opposed ribs by moving the closing tool along said rail includes pressing together said wings to contact said plurality of sets of opposed ribs.

* * * * *

UNITED STATES PATENT AND TRADEMARK OFFICE

CERTIFICATE OF CORRECTION

PATENT NO. : 7,661,918 B2
APPLICATION NO. : 10/853065
DATED : February 16, 2010
INVENTOR(S) : Colin Knight It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 847 days.

Signed and Sealed this

Thirtieth Day of November, 2010

David J. Kappos

David J. Kappos
*Director of the United States Patent and Trademark Office*